United States Patent [19]

Nercessian

[11] Patent Number: 5,061,821

[45] Date of Patent: Oct. 29, 1991

[54] LOUDSPEAKER CABLE

[75] Inventor: Kevork Nercessian, Seefeld, Fed. Rep. of Germany

[73] Assignee: Nachrichtentechnische Vertriebs-Gesellschaft mbH, Seefeld, Fed. Rep. of Germany

[21] Appl. No.: 456,678

[22] Filed: Dec. 27, 1989

Related U.S. Application Data

[63] Continuation-in-part of Ser. No. 291,051, Dec. 28, 1988, abandoned.

[30] Foreign Application Priority Data

Dec. 15, 1988 [DE] Fed. Rep. of Germany ..... 3842277
Oct. 30, 1989 [DE] Fed. Rep. of Germany ..... 3936143

[51] Int. Cl.[5] ..... H01B 11/02

[52] U.S. Cl. ..... 174/34; 174/113 R; 174/113 A; 174/126.2

[58] Field of Search ..... 174/32, 34, 113 R, 113 A, 174/126.2

[56] References Cited

U.S. PATENT DOCUMENTS

| | | | |
|---|---|---|---|
| 529,559 | 11/1894 | Marsh | 174/34 X |
| 1,082,258 | 12/1913 | Kitsee | 174/113 R |
| 3,209,064 | 9/1965 | Cutler | 174/113 R |
| 3,297,855 | 1/1967 | Bowers | 174/126.2 X |
| 3,361,871 | 1/1968 | Brandt | 174/113 R |
| 3,433,890 | 3/1969 | Gabriel et al. | 174/113 R |
| 3,678,177 | 7/1972 | Lawrenson | 174/113 R X |
| 3,692,924 | 9/1972 | Nye | 174/126.2 X |
| 4,125,741 | 11/1978 | Wahl et al. | 174/113 A X |
| 4,408,089 | 10/1983 | Nixon | 174/34 |
| 4,582,545 | 4/1986 | Kamada et al. | 148/432 X |
| 4,741,041 | 4/1988 | Hayashi | 381/168 X |
| 4,754,102 | 6/1988 | Dzurak | 174/34 X |
| 4,755,629 | 7/1988 | Beggs et al. | 174/34 |

OTHER PUBLICATIONS

Yotsuya, Masami et al.; an Approach to Crosstalk Coupling Reduction of pair Type Cable; Conference, Proceedings of the 13th, 23rd International Wire and Cable Symposium, Atlantic City, N.J. U.S.A.; Dec. 3-5, 74.

*Primary Examiner*—Morris H. Nimmo
*Attorney, Agent, or Firm*—Flynn, Thiel, Boutell & Tanis

[57] ABSTRACT

A cable for the transmission of signals from an amplifier to a loudspeaker which includes two insulated conductors forming respective leads, and a sheath enclosing the two leads. The conductors can be solid wires having a smooth surface and made of oxygen-free copper. In the alternative, the conductors can be composed of elementary wires, the elementary wires of each conductor being stranded together in the same wire drawing direction, and the conductor composed of the stranded elementary wires being of a unilay structure, the conductor being additionally compressed.

23 Claims, 1 Drawing Sheet

LOUDSPEAKER CABLE

This application is a continuation-in-part of application Ser. No. 07/291,051 filed Dec. 28, 1988, now abandoned.

DESCRIPTION

1. Field of the Invention

The invention relates to a cable for the transmission of signals from an amplifier to a loudspeaker, comprising two conductors each constituting a respective lead, and a sheath enclosing said leads.

2. Background of the Invention

In the case of audio equipment including one or more loudspeakers placed at a distance from the amplifier, there exists the problem of transmitting audio signals from the amplifier to the loudspeakers without loss and distortion, the signals to be thus transmitted being sometimes of considerable power. In this case by far the major proportion of the total power of the signals to be transmitted is generally contributed by the low audio frequencies, the higher frequencies participating only to a small proportion to the overall signal power.

A cable of the type defined in the introduction for the transmission of signals from an amplifier to a loudspeaker is described in German Utility Model 83 29 717. The conductors of this cable consist of an inner conductor component and an outer conductor component surrounding the inner conductor component and insulated therefrom by a dielectric material, the inner and outer conductor components being electrically connected to one another at respective terminal elements. This annular cross-sectional configuration of the conductor composed of an inner and outer conductor component is intended to obtain an improvement of the transmission characteristics with regard to quantity and quality, i.e. with regard to the power and the fidelity of the audio signals. This configuration of the conductor is effective particularly to reduce the influences of external magnetic fields as well as the interference between the conductors of the cable themselves.

This cable as well as other known cables for the transmission of audio signals from an amplifier to a loudspeaker are still, however, capable and in need of improvement. It is therefore an object of the invention to provide a cable of the type defined in the introduction for the transmission of signals from an amplifier to a loudspeaker, which cable is to be characterized by improved transmission characteristics as compared to conventional cables.

In accordance with the invention this object is attained by the provision that the conductors comprise solid wires having a smooth surface and made of oxygen-free copper. The smooth surface is effective to eliminate interference capacities and inductivities otherwise occurring between the apices of an uneven surface.

Another solution according to the invention provides that the conductors are stranded conductors composed of elementary wires having a smooth surface and made of oxygen-free copper, the elementary wires of each conductor being stranded together in the same drawing direction, the stranded conductor composed of said elementary wires having a compacted structure. The compaction of the conductor is effective to eliminate interferences resulting from capacities and inductivities between the elementary wires.

A cable which is characterized by combinations of these features according to the invention is capable of providing a considerably improved transmission quality as compared to conventional cables. The cable according to the invention is thus capable of substantially eliminating attenuation and phase variations between the different frequencies to be transmitted at different powers, which, although very slight, have a strong prejudicial influence on the originality of the sound perception. This is due to the fact that an equalization of the complex resistance is achieved for the low, intermediate and high frequency range.

In an advantageous embodiment of the invention the elementary wires of each conductor may be stranded in layers (unilay stranding) and additionally compressed to thereby obtain the compacted structure of the stranded conductor.

According to a further advantageous embodiment of the invention, and for still further improving the transmission characteristics of the cable, the two leads may be twisted together with a small pitch, so that the conductors extend at an angle of approximately 90° relative to one another.

This provision is mainly effective for substantially eliminating any influences of the conductors upon one another by way of their magnetic fields.

The material preferably employed for the insulation of the conductor is polyethylene having a low relative dielectric constant of 2.2 and an insulation resistivity of more than 10,000 MΩ/km. An insulation of this kind permits the leakage factor to be kept very low, this factor representing the effective proportion of the cross current flow between two conductors resulting from insufficient insulation and dielectric losses.

In a still further advantageous embodiment of the invention the sheath of the cable may be formed as a PVC hose surrounding the twisted leads with the inclusion of air in the wedge-shaped spaces therebetween. The low dielectric constant of the air additionally contributes to keeping leakage as small as possible. In still another advantageous embodiment of the invention, the insulation and/or the sheath are or is, respectively, free of additives having magnetic effects.

The above-mentioned provisions for the advantageous implementation of the invention, individually effective to eliminate interferences resulting from the capacity and inductivity between the elementary wires in the copper conductor itself, to reduce the effective resistance of the conductors, to increase the complex insulation resistance between the conductors, and to reduce the capacity and inductivity of the cable, result, particularly when employed in combination, in still further improved transmission characteristics and thus in a still further improvement of the originality of sound perception.

BRIEF DESCRIPTION OF THE DRAWINGS

Further advantageous aspects of the invention are apparent from the described embodiments of the invention and referencing the accompanying drawings, wherein.

DETAILED DESCRIPTION

Figure 1:
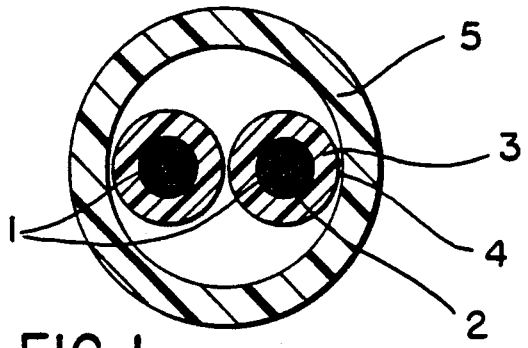
FIG. 1 shows a cross-sectional view of a loudspeaker cable according to the invention in an embodiment comprising conductors each composed of 61 elementary wires.
Figure 2:
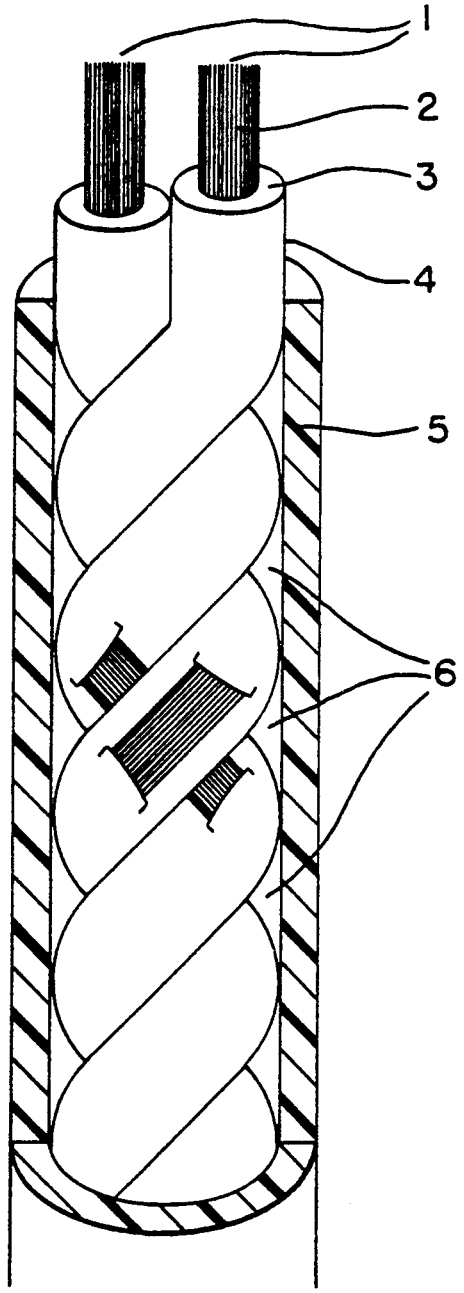
FIG. 2 shows a sideview of the embodiment of FIG. 1, with respective cutouts in the sheath and in the insulation of one of the two conductors.

Indicated at 1 in FIGS. 1 and 2, respectively, are two conductors each provided with an insulation 3. Each conductor 1 with its insulation 3 forms a lead 4. The two leads 4 are twisted together in such a manner that their conductors 1 extend at an angle of approximately 90° relative to one another. In the example shown, each conductor 1 is composed of sixty-one fine elementary wires 2 having a diameter of 0.16 mm, the wires being stranded in concentric layers of one, six, twelve, eighteen and twenty-four wires, respectively in unilay structure.

According to the present embodiment the elementary wires forming the layers are stranded at the same helical direction and at the same pitch (unilay structure). In this case the elementary wires of an upper layer are disposed in the grooves between two adjacent wires of the layer below so that a high density of the elementary wires within the stranded conductor is achieved and many electrical contacts between the elementary wires are formed.

The thus composed stranded conductor is compressed, e.g. by drawing through a wire-drawing bench, to thereby eliminate the capacities and inductivities between the elementary wires in the conductor. The elementary wires are stranded together in the same wire drawing direction. The term "wire drawing direction" indicates the direction in which the wires are drawn during their manufacture for the reduction of their cross-sectional size, this drawing operation resulting in the formation of a specific crystalline structure affecting the electric resistance. The elementary wires are made of oxygen-free copper and provided with a silver plating having a smooth surface.

Instead of the conductors 1 composed of elementary wires, and as specified in claim 1, it is also possible to employ conductors in the form of solid wires made of oxygen-free copper and having a smooth surface. A smooth surface may be obtained for instance by employing highly accurate drawing tools ensuring the formation of a smooth surface in the production of the wires. A smooth silver surface on the elementary wires may be formed by depositing a silver plating of relatively great thickness in an electrolytic process.

The conductors composed of elementary wires are subsequently compressed. In the compressed state the diameter of the substantially circular cross-section of the conductor is 1.31 mm. In the not yet compressed state the diameter of the conductor had been 1.44 mm. The sixty-one elementary wires result in a combined cross-sectional area of the conductor of 1.22 $mm^2$.

The insulation 3 is made of polyethylene and has a wall thickness of 1.1 mm, so that the resultant lead has a diameter of 3.7 mm. Indicated at 5 is a PVC hose enclosing the two leads 4. The PVC hose has a circular or annular cross-sectional shape with an outer diameter of 9.5 mm and a wall thickness of 1.2 mm. Both the polyethylene insulation 3 and the PVC hose sheath are free of any colouring additives which might influence the dielectric constant and inductivity.

A cable of the type described with wires made of oxygen-free copper and having a smooth surface is capable of achieving a substantially improved transmission quality as compared to conventional cables. The cable according to the invention is effective to substantially eliminate attenuation and phase variations between the different frequencies to be transmitted with very different powers which, although very slight, have a strong prejudicial influence on the originality of the sound perception. This is due to the fact that an equalization of the complex resistance is achieved for the low, intermediate and high frequency ranges.

The great diameter of the conductors results in a reduced Ohmic resistance of the cable. The insulation made of polyethylene or expanded polyethylene ensures a high insulation resistance between the conductors and, thanks to the low dielectric constant of this insulating material, also a reduced capacity of the cable. The relatively great wall thickness of the insulation results in a wide spacing between the conductors and thus in a reduced inductivity of the cable and in an additionally reduced capacity. The capacity and inductivity are still further reduced by the presence of air inclusions 6 (dielectric constant=1) in the wedge-shaped spaces between the leads and the protective PVC sheath, in other words by the fact that the leads are not embedded in the material of the protective sheath PVC (dielectric constant>3) as in conventional cables. An important reason for the low inductivity of the cable is mainly the specific manner in which the leads are twisted. Since the two conductors extend substantially perpendicular to one another, the current flow in one conductor is always directed substantially perpendicular to the field lines of the magnetic field of the other conductor, so that the influence of induction on the transmission characteristics is strongly reduced.

The equilibrium within the conductors themselves, i.e. the balanced resistance for all frequency ranges, the reduced value of the complex conductor resistance, i.e. the sum of the DC resistance and the effective resistance, the increased insulation resistance and the reduction of the cable's capacity and inductivity result in a loudspeaker cable having improved transmission characteristics.

A further preferred embodiment employing solid wires is characterized by the following numerical data:

Cross-sectional area: 2.5 $mm^2$
Conductor configuration: solid conductor with round cross-sectional shape
Conductor diameter: 1.78 mm
Insulation: polyethylene
Wall thickness of insulation: 1.30 mm
Outer diameter of insulation: 4.40 mm
Sheathing: PVC hose
Wall thickness of sheathing: 1.20 mm
Outer diameter of sheathing: 11.00 mm
Capacity at 30 Hz to 10 kHz: <50 pF/m
Inductivity at 30 Hz to 10 kHz: <0.72 mH/km The described loudspeaker cables according to the invention may also be provided with an outer shielding.

The embodiments of the invention in which an exclusive property or privilege is claimed are defined as follows:

1. A cable for the transmission of signals from an amplifier to a loudspeaker, comprising two insulated conductors each forming a respective lead, and a sheath enclosing said leads, said conductors being stranded conductors composed of elementary wires having a smooth surface and made of oxygen-free copper, the elementary wires of each conductor being stranded together in the same wire drawing direction, and the stranded conductor composed of said elementary wires having a compacted structure.

2. The cable according to claim 1, wherein said two leads are twisted together with a small pitch, so that said conductors extend at an angle of approximately 90° relative to one another.

3. The cable according to claim 1, wherein the insulations of said conductors are made of polyethylene.

4. The cable according to claim 1, wherein the wall thickness of said insulation is dimensioned for minimizing the cable capacity, inductivity and leakage (dielectric losses).

5. The cable according to claim 4, wherein the ratio between the wall thickness of said insulation and the diameter of said conductors is at least 1:2.

6. The cable according to claim 2, wherein said sheath surrounds said twisted leads in the manner of a hose, with the inclusion of air in the wedge-shaped spaces between said leads.

7. The cable according to claim 6, wherein said sheath is formed of a PVC hose.

8. The cable according to claim 7, wherein the wall thickness of said PVC hose is about 1.20 mm.

9. The cable according to claim 1, wherein said insulation and/or said sheath are or is, respectively, free of additives having magnetic effects.

10. The cable according to claim 2, wherein said conductor has a diameter of at least 1.5 mm.

11. The cable according to claim 10, wherein said conductor has a diameter of 1.78 mm.

12. The cable according to claim 11, wherein the wall thickness of said insulation is 1.3 mm.

13. The cable according to claim 12, wherein the outer diameter of said PVC hose is 11 mm.

14. The cable according to claim 1, wherein said elementary wires are provided with a silver plating.

15. The cable according to claim 1, wherein the diameter of said elementary wires is 0.2 mm or less.

16. The cable according to claim 1, wherein the diameter of said elementary wires is at least 0.13 mm.

17. The cable according to claim 16, wherein the diameter of said elementary wires is 0.16 mm.

18. The cable according to claim 1, wherein each stranded conductor has its elementary wires stranded in said compacted structure and the whole conductor compressed additionally.

19. The cable according to claim 18, wherein the elementary wires of each stranded conductor are stranded together in layers of 1+6+12+18+24 wires in that order.

20. The cable according to claim 18 or 19, wherein each stranded conductor is composed of 61 elementary wires.

21. The cable according to claim 1, wherein the diameter of said conductors in the non-compacted state is 1.44 mm.

22. The cable according to claim 1, wherein the diameter of said conductors is 1.31 mm in the compacted state.

23. The cable according to claim 18, wherein said elementary wires forming said layers are stranded at the same helical direction and at the same pitch (unilay structure).

* * * * *

UNITED STATES PATENT AND TRADEMARK OFFICE

CERTIFICATE OF CORRECTION

PATENT NO. : 5 061 821

DATED : October 29, 1991

INVENTOR(S) : Kevork NERCESSIAN

It is certified that error appears in the above-identified patent and that said Letters Patent is hereby corrected as shown below:

Column 5, line 12; change "claim 2" to ---claim 1---.

Signed and Sealed this

Fourth Day of May, 1993

*Attest:*

Michael K. Kirk

MICHAEL K. KIRK

*Attesting Officer*

*Acting Commissioner of Patents and Trademarks*